US010046882B2

(12) United States Patent
Budny et al.

(10) Patent No.: US 10,046,882 B2
(45) Date of Patent: Aug. 14, 2018

(54) REDUCED-WIDTH BLANK FOR FORMING A CARTON AND SHEET CONTAINING SUCH BLANKS

(71) Applicant: MALNOVE PACKAGING SOLUTIONS, Alpharetta, GA (US)

(72) Inventors: Tom Budny, Lincoln, CA (US); Leo Quinones, Jacksonville, FL (US); Tom Simpson, Luka, MS (US)

(73) Assignee: Malnove Incorporated, Omaha, NE (US)

( * ) Notice: Subject to any disclaimer, the term of this patent is extended or adjusted under 35 U.S.C. 154(b) by 0 days.

(21) Appl. No.: 15/103,245

(22) PCT Filed: Dec. 12, 2014

(86) PCT No.: PCT/US2014/070103
§ 371 (c)(1),
(2) Date: Jun. 9, 2016

(87) PCT Pub. No.: WO2015/089445
PCT Pub. Date: Jun. 18, 2015

(65) Prior Publication Data

US 2016/0318649 A1 Nov. 3, 2016

Related U.S. Application Data

(60) Provisional application No. 61/915,164, filed on Dec. 12, 2013.

(51) Int. Cl.
*B65D 5/18* (2006.01)
*B65D 5/42* (2006.01)
(Continued)

(52) U.S. Cl.
CPC ..... *B65D 5/18* (2013.01); *B65D 5/4266* (2013.01); *B65D 5/6685* (2013.01); *B65D 21/0233* (2013.01); *B65D 2301/10* (2013.01)

(58) Field of Classification Search
CPC ..... B65D 5/18; B65D 5/6685; B65D 5/4266; B65D 21/0233; B65D 5/5002
(Continued)

(56) References Cited

U.S. PATENT DOCUMENTS 2,890,791 A * 6/1959 Wenzel ..... B65D 5/16 206/494
3,036,729 A * 5/1962 Asman ..... B65D 5/16 206/449
(Continued)

FOREIGN PATENT DOCUMENTS

WO WO 03/084822 A2 10/2003

*Primary Examiner* — Christopher Demeree
(74) *Attorney, Agent, or Firm* — Cozen O'Connor

(57) ABSTRACT

A blank for forming a carton, the blank including a first panel and a second panel adjoining the first panel along a fold line and extending in a longitudinal direction of the blank. A pair of side panels adjoins the second panel at respective fold lines. The side panels extend from the second panel in a transverse direction of the blank. The side panels each having a side panel flap adjoining at a fold line, the side panel flaps extending from the side panels in the longitudinal direction of the blank, toward the first panel. The blank further includes a third panel adjoining the second panel along a fold line and extending in the longitudinal direction of the blank. The blank further includes a fourth panel adjoining the third panel along a fold line and extending in the longitudinal direction of the blank.

18 Claims, 15 Drawing Sheets

(51) Int. Cl.
*B65D 21/02* (2006.01)
*B65D 5/66* (2006.01)

(58) Field of Classification Search
USPC ..... 229/120.01, 125.19, 143, 232; 206/494, 206/273, 449; 221/305
See application file for complete search history.

(56) References Cited

U.S. PATENT DOCUMENTS

| | | | | |
|---|---|---|---|---|
| 3,254,793 | A * | 6/1966 | Palmer | B65D 5/16 221/155 |
| 4,459,127 | A * | 7/1984 | Kunzel | B65D 83/0852 206/494 |
| 2003/0116613 | A1 | 6/2003 | McLeod et al. | |
| 2003/0234252 | A1 | 12/2003 | Howard | |
| 2006/0049074 | A1 | 3/2006 | Long et al. | |

* cited by examiner

REDUCED-WIDTH BLANK FOR FORMING A CARTON AND SHEET CONTAINING SUCH BLANKS

CROSS-REFERENCE TO RELATED APPLICATION

This is a U.S. National Phase Application under 35 USC 371 of International Application PCT/US2014/07013 filed on Dec. 12, 2014, which claims priority to U.S. Provisional Patent Application No. 61/915,164, filed Dec. 12, 2013, both of which are hereby incorporated by reference.

FIELD OF THE INVENTION

The disclosed embodiments relate to a blank for forming a carton and a sheet containing such blanks. More specifically, the disclosed embodiments relate to a paperboard blank having a reduced width and a paperboard sheet containing a number of such blanks in an efficient arrangement.

BACKGROUND OF THE INVENTION

Cartons or boxes are often used for storing and merchandising consumer goods. Such cartons may be formed from flat paperboard blanks, which are folded, filled with product, and sealed by machines in an automated process. Depending upon the configuration of the panels and flaps of the blank which fold together to form the carton, the number of blanks that can fit on a single sheet of material may be limited. In addition, the portions of the sheet of material that remain as wasted blank pieces after the blanks are removed (e.g., cut out) may take up a significant part of the sheet of material. Conventionally, these wasted portions of the sheet of material that remain after removing the blanks for the individual cartons are substantial. In some cases, as much as 55% of a flat blank goes wasted as the cutout portions. Conventional packaging systems used by consumer packaged-goods companies have not been entirely successful in lowering the environmental impact of the packages they use to package, distribute and market their products at retail, while increasing packaging productivity across the supply chain.

SUMMARY OF THE INVENTION

The disclosed embodiments provide a flat blank, and a sheet of such blanks, to form packaging cartons for filling with consumer products and sealing in an automated process. The packaging cartons are formed in a manner that provides significant efficiencies and environmental benefits through materials reduction while maintaining structural integrity during the formation, filling and sealing process. The packaging cartons formed from the blanks described herein can be used in the packaging of single or multiple items of consumer goods, such as pharmaceutical products, frozen foods, baked goods, prepared foods, dry goods, paper, meat, poultry, coffee, tea and sugar and sugar substitutes.

The objective efficiency and environmental benefits are achieved through positioning of carton blank formation flaps/panels that allow for package formation and subsequent product introduction and sealing on standard carton formation systems with a unique method of formation modifications and adjustments. Such positioning of carton blank formation panels allows the packaging carton layout to be processed efficiently by both the manufacturer of the carton blanks as well as the end user, such as the consumer packaged-goods company.

The conversion of the flat blank to folding package carton as well as all subsequent package formation steps are based on the formation flaps/panels that are positioned in an especially efficient pattern. Changing the orientation of the formation flaps/panels on the packaging cartons enables increases in conversion efficiencies between flat paperboard materials and finished cartons while maintaining the ability to easily and efficiently form, fill and seal the carton as well as maintaining the structural integrity of the finished package.

In one aspect, the disclosed embodiments provide a blank for forming a carton. The blank includes a first panel and a second panel adjoining the first panel along a fold line and extending in a longitudinal direction of the blank. A pair of side panels adjoins the second panel at respective fold lines, the side panels extending from the second panel in a transverse direction of the blank. The side panels each have a side panel flap adjoining at a fold line. The side panel flaps extend from the side panels in the longitudinal direction of the blank, toward the first panel. The blank further includes a third panel adjoining the second panel along a fold line and extending in the longitudinal direction of the blank. The third panel has a pair of flaps extending in the transverse direction of the blank. The blank further includes a fourth panel adjoining the third panel along a fold line and extending in the longitudinal direction of the blank. The fourth panel has a pair of flaps extending in the transverse direction of the blank and a flap extending in the longitudinal direction of the blank.

In another aspect, the disclosed embodiments provide a sheet having blanks for forming cartons. The sheet includes a number of blanks, described above, arranged in one or more rows, the blanks of each row being adjacent to one another in a transverse direction of the blanks. The orientation of the blanks is reversed in a longitudinal direction of the blanks in an alternating manner to form a nested arrangement of the blanks.

Certain embodiments may provide one or more of the following features.

A total width in the transverse direction of the second panel and the pair of side panels may be the maximum width of the blank in the transverse direction. A total length in the longitudinal direction of the first panel and the second panel may be less than about half of the length of the blank in the longitudinal direction. The first panel may be about the same size as the third panel, excluding the pair of flaps of the third panel. The second panel may be about the same size as the fourth panel, excluding the flaps of the fourth panel. Each of the side panel flaps may be chamfered at a corner nearest the first panel.

The blanks may be arranged in a nested manner which does not have an offset in the longitudinal direction of the blanks between any blank and an adjacent blank in the same row. The height of each row may be equal to the length of the blanks in the longitudinal direction.

BRIEF DESCRIPTION OF THE DRAWINGS

The following description, given with respect to the attached drawings, may be better understood with reference to the non-limiting examples of the drawings, wherein.

DETAILED DESCRIPTION

Figure 1:
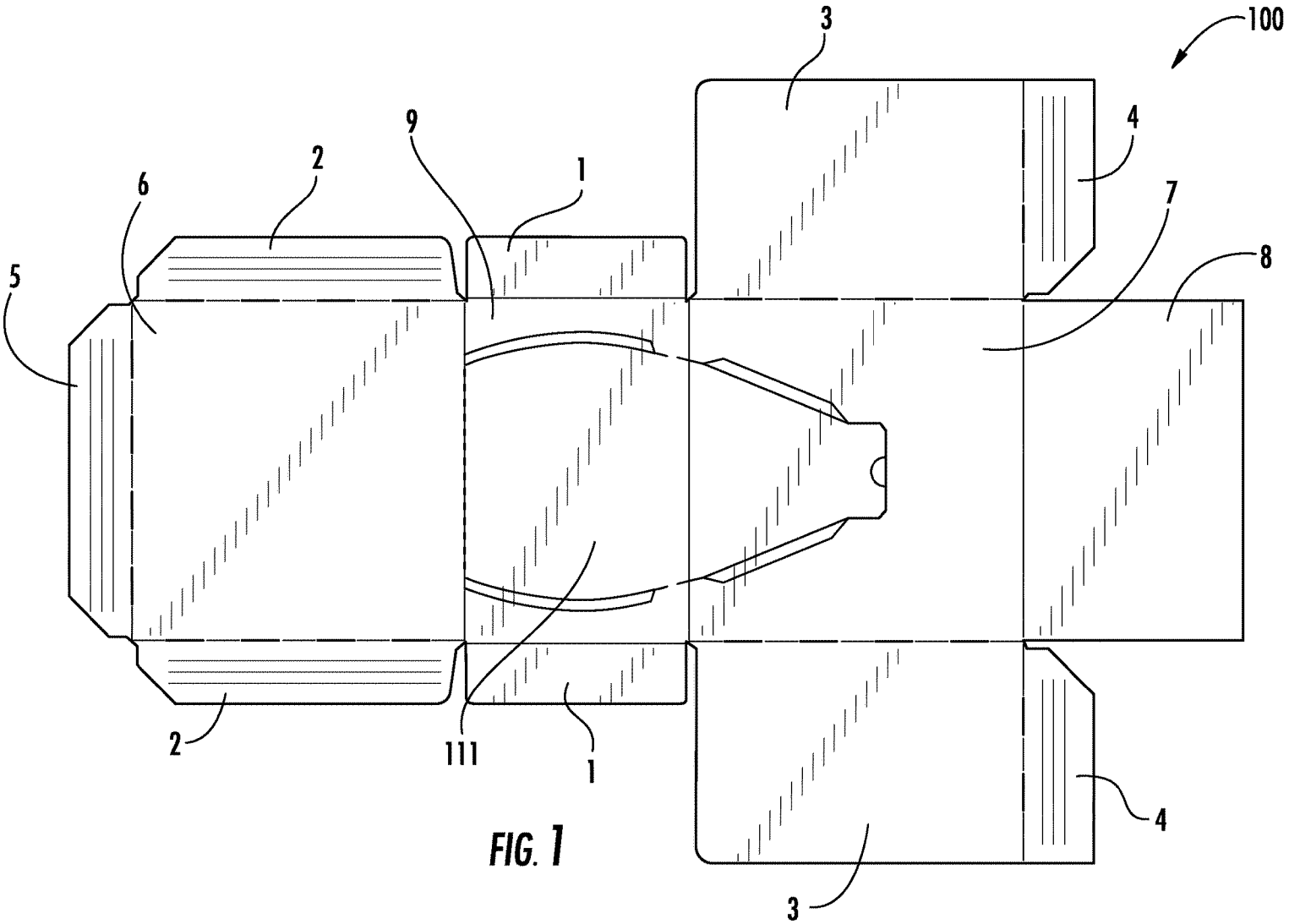
FIG. 1 depicts a paperboard blank used to form a carton in accordance with the disclosed embodiments.

FIG. 1 shows an embodiment of a paperboard blank 100, i.e., pattern or layout, for forming a carton. The carton may be configured for holding consumer products or goods, such as, for example, single-use coffee products (e.g., Keurig cups or "K-cups"). As described in further detail below, the layout comprises formation panels and flaps which are positioned for achieving converting efficiency and reduction of wasted portions of flat blanks. The panels, generally speaking, become a major surface of the completed carton (e.g., front, back, sides, bottom, or top), whereas the flaps are mainly used to interconnect the panels. Although, the embodiments described herein are formed of paperboard, other materials may be used, such as, for example, paper, cardboard, fiberboard, plastic, composite materials, laminated paperboard, and corrugated variations of such materials.

The blank 100 includes a first panel, which may be a bottom panel 8 of the carton. The blank 100 further includes a second panel, which may be a back panel 7 of the carton, adjoining the bottom panel 8 along a fold line and extending in a lengthwise, i.e., longitudinal direction, of the blank 100 (the longitudinal direction being the horizontal direction in the depiction of FIG. 1).

A pair of side panels 3 adjoins the back panel 7 at respective fold lines. The side panels 3 extend from the back panel 7 in a width-wise, i.e., a transverse, direction of the blank 100 (which is the direction perpendicular to the longitudinal direction). The side panels 3 each have a side panel flap 4 adjoining at a fold line. The side panel flaps 4 extend from the side panels 3 in the longitudinal direction of the blank 100, toward the bottom panel 8, rather than extending outward in the transverse direction. This is advantageous in that it reduces the overall width of the blank 100 in the transverse direction.

A third panel, which may be the top 9 of the carton, adjoins the back panel 7 along a fold line and extending in the longitudinal direction of the blank 100. The top panel 9 has a pair of flaps 1 extending in the transverse direction of the blank 100. The top panel 9 may also have a partially-cut section 111 which serves as a reclosable flap for opening the container to access the product.

A fourth panel, which may be the front 6, i.e., face, panel of the carton, adjoins the top panel 9 along a fold line and extends in the longitudinal direction of the blank 100. The front panel 6 has a pair of flaps 2 extending in the transverse direction of the blank and another flap 5 extending in the longitudinal direction of the blank 100.

The blank 100 depicted in FIG. 1 is configured so that a total width in the transverse direction of the back panel 8 and the pair of side panels 3 is the maximum width of the blank 100 in the transverse direction. As noted above, the arrangement of the side panel flaps 4 so that they extend in the longitudinal direction of the blank 100, toward the bottom panel 8, rather than outward in the transverse direction, results in a reduced maximum width of the blank. For a carton configured to hold, e.g., 12 K-cups, the maximum width of the blank 100 may be about 13 inches. In such a configuration, the side panels 3 may have a width of about 3.7 inches and a length of about 3.7 inches (i.e., in the longitudinal direction of the blank). The side panel flaps 4 may be about 1.2 inches in the longitudinal direction of the blank 100 and 3.7 inches in the transverse direction.

The length of the blank 100 in the longitudinal direction may be about 15.9 inches in this particular embodiment. The side panels 3, as noted above, extend from the back panel 7, rather than, for example, the top panel 9. Consequently, the portions of the blank 100 which extend in the transverse direction are closer to the end of the blank 100 in the longitudinal direction than they otherwise might be. This results in a configuration in which the total length in the longitudinal direction of the bottom panel 8 and the back panel 7 (e.g., about 7.4 inches) is less than about half of the length of the blank 100 in the longitudinal direction.

In particular embodiments, the bottom panel 8 may be about the same size as the top panel 9, excluding the pair of flaps 1 of the top panel 9. For example, the bottom panel 8 and top panel 9 may each be about 5.6 inches wide and about 3.7 inches long (i.e., in the longitudinal direction of the blank). The back panel 7 may be about the same size as the front panel 6, excluding the flaps (2, 5) of the front panel 6. For example, the back panel 7 and front panel 6 may each be about 5.6 inches wide and about 3.7 inches long (i.e., in the longitudinal direction of the blank). The flaps (1, 2, 5) of the top panel 9 and front panel 6 may extend from those panels by about 1.0 inch.

Figure 2:
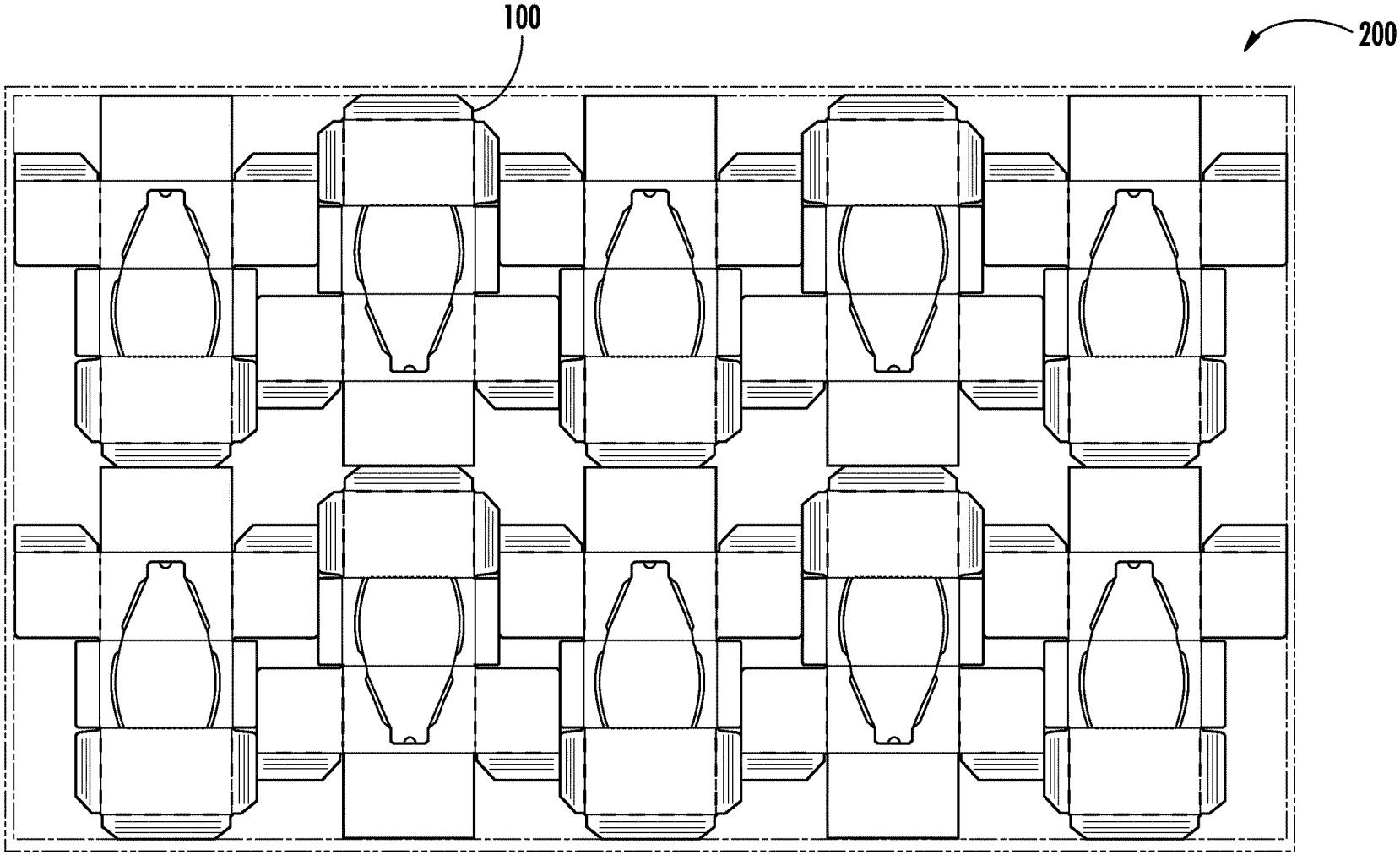
FIG. 2 depicts a paperboard sheet containing an arrangement of blanks of a particular size for forming cartons.

FIG. 2 depicts packaging carton layouts, i.e., a paperboard sheet 200 of blanks 100 for forming cartons. The sheet 200 includes a number of the blanks 100 depicted in FIG. 1, e.g., ten blanks 100, arranged in one or more rows. The blanks 100 of each row are adjacent to one another in a transverse direction of the blanks 100. To fit a maximum number of blanks 100 on a single sheet 200 of paperboard stock, the orientation of the blanks 100 is reversed in a longitudinal direction of the blanks 100 in an alternating manner to form a nested arrangement of the blanks 100.

Significantly, the blanks 100 are nested in an alternating manner which does not require an offset in the longitudinal direction of the blanks between one blank and an adjacent blank in the same row. In other words, the blanks are arranged in rows such that the height of each row is equal to the length of the blanks in the longitudinal direction.

This nested arrangement is made possible by virtue of the fact that, as noted above, the side panels 3 extend from the back panel 7, rather than, for example, from the top panel 9. Consequently, the portions of the blank 100 which extend in the transverse direction are closer to the end of the blank 100 in the longitudinal direction than they otherwise might be. This results in a configuration in which the total length in the longitudinal direction of the bottom panel 8 and the back panel 7 is less than about half of the length of the blank 100 in the longitudinal direction.

As discussed above, the arrangement of the side panel flaps 4 so that they extend in the longitudinal direction of the blank 100, toward the bottom panel 8, rather than outward in the transverse direction, results in a reduced maximum width of the blank 100. For example, for the embodiment of FIG. 2, when compared to a configuration in which the side panel flaps 4 extend outward in the transverse direction, the maximum width of the blank is reduced by about 2.4 inches (i.e., two times the outwardly extending dimension of the flaps 4, which in this example is about 1.2 inches).

As shown in FIG. 2, this allows an arrangement of ten blanks 100 (i.e., two rows of five) on a paperboard sheet 200 measuring about 32.7 inches by about 55.4 inches. By contrast, in a configuration in which the side panel flaps 4 extended outward in the transverse direction, only eight blanks could fit on a sheet of that size. Any space on a paperboard sheet which does not constitute part of a blank 100 becomes paperboard waste. Therefore, a more compact arrangement of blanks 100 on the sheet, such that the sheet holds ten blanks 100 rather than eight blanks, results in a significant reduction in paperboard waste.

The inventors of the disclosed embodiments have found that the benefit to a converter of the die-cut blanks in the example discussed above is an approximately 40% reduction in production hours directly related to die cutting and printing the blanks. The benefit to a consumer packaged-goods company for forming, filling and sealing the die-cut blanks in the examples discussed above is an approximately 38% reduction in base raw materials required to produce the die cut blanks.

Figure 3:
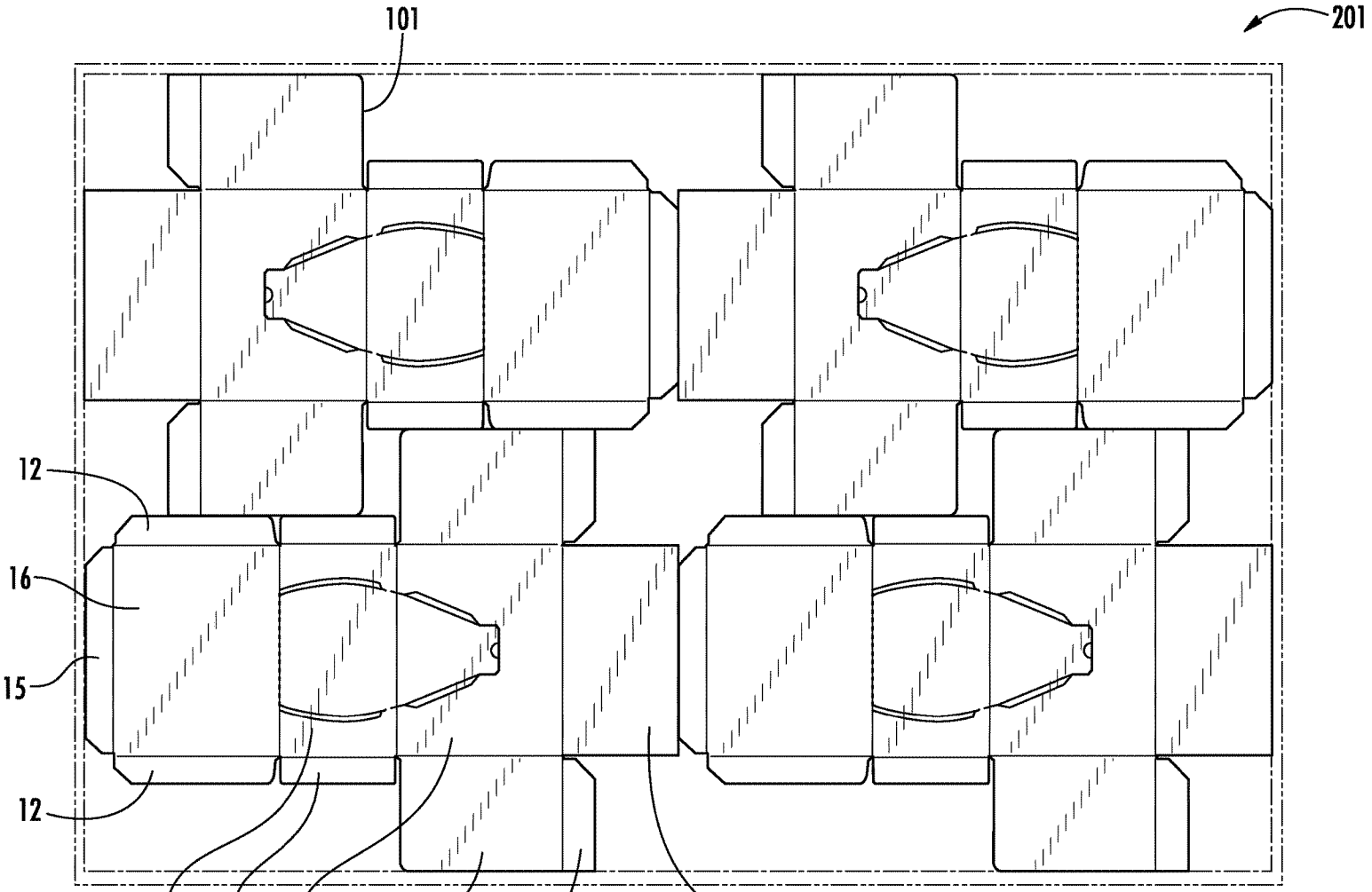
FIG. 3 depicts a paperboard sheet containing an arrangement of blanks of a particular size for forming cartons.

FIG. 3 depicts another embodiment of a paperboard sheet 201 of blanks 101 for forming cartons configured and dimensioned for packaging 24 K-cups. As in the embodiment of FIGS. 1 and 2, the blank 101 is configured so that a total width in the transverse direction of the back panel 17 and the pair of side panels 13 is the maximum width of the blank 101 in the transverse direction. In this particular embodiment, the maximum width of the blank 101 may be about 16.2 inches, and the side panels 13 have a width of about 4.2 inches and a length of about 6.1 inches (i.e., in the longitudinal direction of the blank). The side panel flaps 14 may be about 1.2 inches in the longitudinal direction of the blank 101 and 4.2 inches in the transverse direction. The length of the blank 101 in the longitudinal direction may be about 21.7 inches. The total length in the longitudinal direction of the bottom panel 18 and the back panel 17 is about 10.3 inches, which is less than about half of the length of the blank 101 in the longitudinal direction.

The bottom panel 18 may be about the same size as the top panel 19, excluding the pair of flaps of the top panel 11. For example, the bottom 18 and top panels 19 may be about 7.7 inches wide and about 4.2 inches long (i.e., in the longitudinal direction of the blank). The back panel 17 may be about the same size as the front panel 16, excluding the flaps (12, 15) of the front panel 16. For example, the back 17 and front panels 16 may be about 7.7 inches wide and about 6.1 inches long (i.e., in the longitudinal direction of the blank). The flaps (11, 12, and 15) of the top 17 and front panels 16 may extend from those panels by about 1.0 inch.

As shown in FIG. 3, the blanks 101 of each row (the rows running in the vertical direction, as depicted in FIG. 3) are adjacent to one another in a transverse direction of the blanks 101, and the orientation of the blanks 101 are reversed in a longitudinal direction of the blanks 101 in an alternating manner to form a nested arrangement of the blanks 101. This allows an arrangement of four blanks 101 (i.e., two rows of two) on a paperboard sheet measuring about 30.2 inches by about 44.2 inches. By contrast, a blank configuration in which the side panel flaps extended outward in the transverse direction would require a significantly larger sheet of paperboard stock, which would result in substantial paperboard waste.

Figure 4:
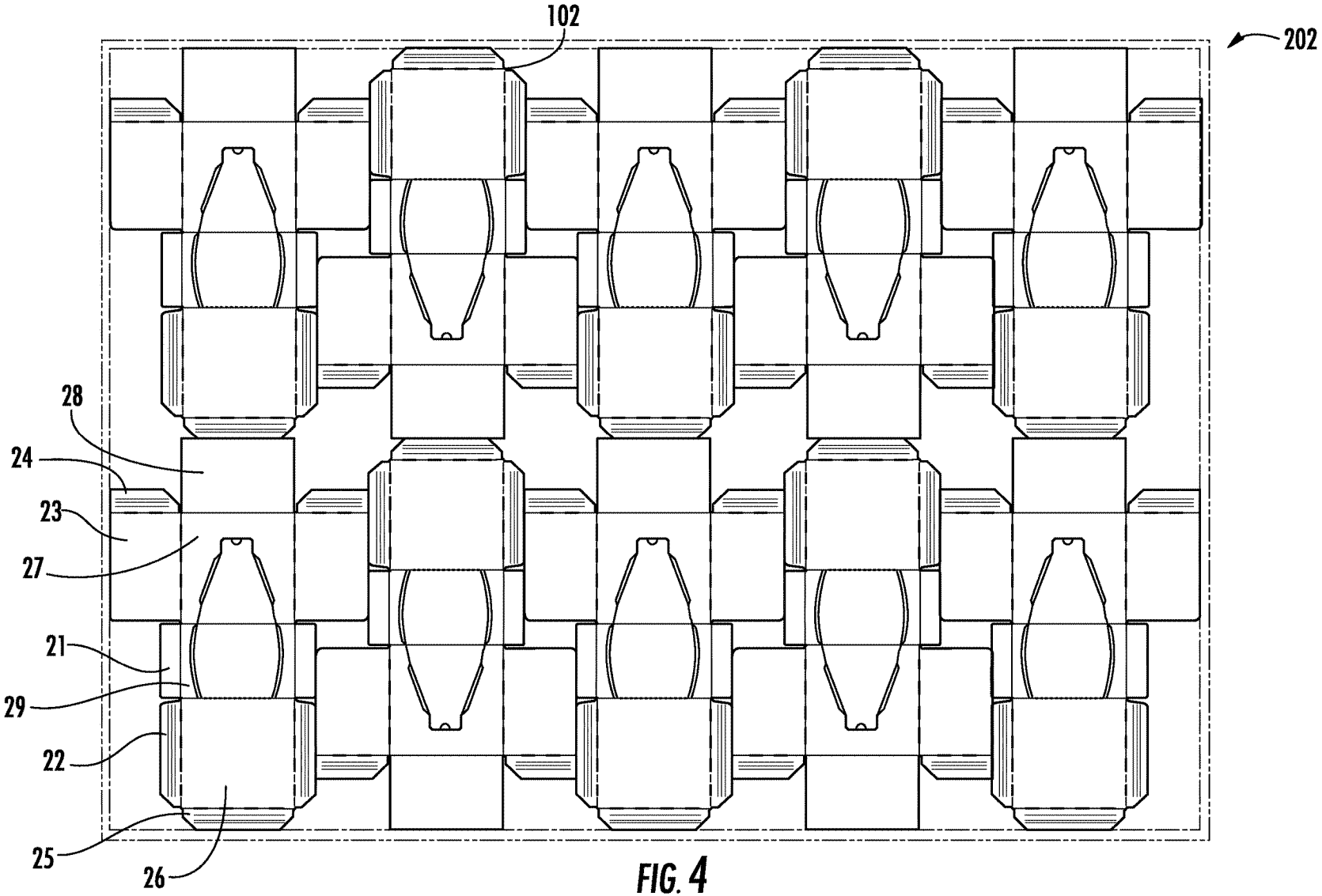
FIG. 4 depicts a paperboard sheet containing an arrangement of blanks of a particular size for forming cartons.

FIG. 4 depicts another embodiment of a paperboard sheet 202 of blanks 102 for forming cartons configured and dimensioned for packaging 18 K-cups. As in the embodiments above, the blank 102 is configured so that a total width in the transverse direction of the back panel 27 and the pair of side panels 23 is the maximum width of the blank 102 in the transverse direction. The maximum width of the blank 102 may be about 13.1 inches, and the side panels 23 have a width of about 3.7 inches and a length of about 5.6 inches (i.e., in the longitudinal direction of the blank). The side panel flaps 24 are about 1.2 inches in the longitudinal direction of the blank 102 and 3.7 inches in the transverse direction. The length of the blank 102 in the longitudinal direction is about 19.6 inches in this particular embodiment. The total length in the longitudinal direction of the bottom panel 28 and the back panel 27 is about 9.3 inches, which is less than about half of the length of the blank 102 in the longitudinal direction.

The bottom panel 28 may be about the same size as the top panel 29, excluding the pair of flaps 21 of the top panel 29. For example, the bottom 28 and top panels 29 may be about 5.7 inches wide and about 3.7 inches long (i.e., in the longitudinal direction of the blank). The back panel 27 may be about the same size as the front panel 26, excluding the flaps (22, 25) of the front panel 26. For example, the back 27 and front panels 26 may be about 5.7 inches wide and about 5.6 inches long (i.e., in the longitudinal direction of the blank). The flaps (21, 22, and 25) of the top 29 and front panels 26 may extend from those panels by about 1.1 inch.

As shown in FIG. 4, the blanks 102 of each row are adjacent to one another in a transverse direction of the blanks 102, and the orientation of the blanks 102 are reversed in a longitudinal direction of the blanks 102 in an alternating manner to form a nested arrangement of the blanks 102. This allows an arrangement of ten blanks 102 (i.e., two rows of five) on a paperboard sheet 202 measuring about 40.0 inches by about 55.5 inches. By contrast, a blank configuration in which the side panel flaps extended outward in the transverse direction would allow for a smaller number of blanks on the same size sheet of paperboard stock, which would result in substantial paperboard waste.

Figure 5:
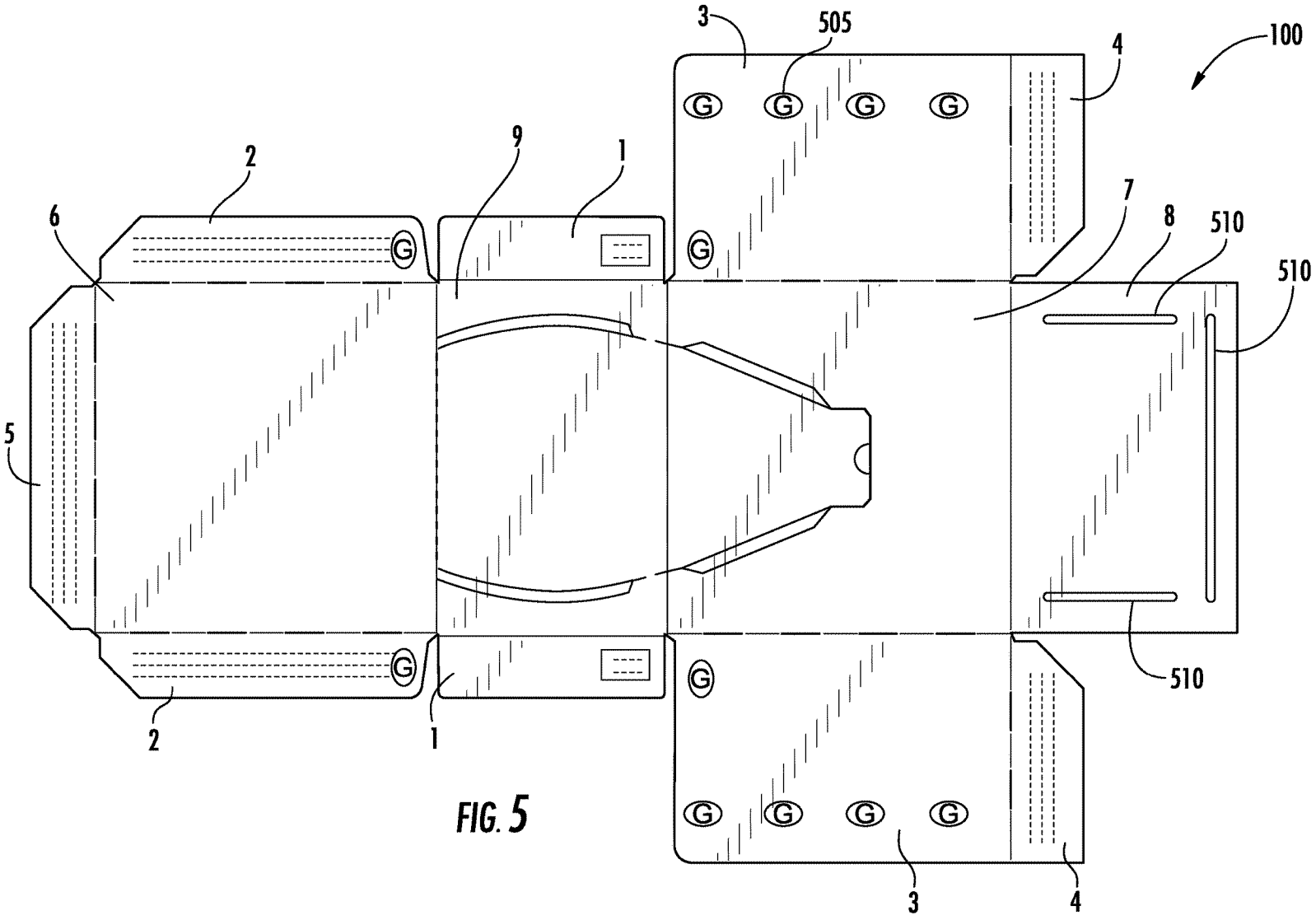
FIG. 5 depicts a glue specification for a paperboard blank used to form a carton.

FIG. 5 depicts a glue specification for a blank, e.g., such as the blank 100 shown in FIG. 1, which shows enumerated formation panels and designated glue spots 505 (indicated by "G"). In addition, there are three hot-melt traits 510 on the bottom panel 8. The glue specification is used in conjunction with the package formation methods discussed below to form a completely assembled carton from the blank.

FIGS. 6-13 depict the package formation steps used to form a carton from a blank according to the disclosed embodiments. Among the advantages of the blank configuration described above is that it can be formed into a carton using a wide range of commonly available automated carton-forming machines, such as, for example, Kliklok carton forming, filling, and closing machines (Kliklok-Woodman, Decatur, Ga.), Cama cartoning machines (Cama USA, Buffalo Grove, Ill.), and Delkor cartoning machines (Delkor Systems, Inc., St. Paul, Minn.). Each of these machines can be reconfigured and/or retooled using specific steps that are designed to form the packaging cartons of the disclosed embodiments. In some cases, the retooling may include installing special gluing heads for gluing particular gluing points specified on one or more panels and/or flaps of the blank, such as the glue specification depicted in FIG. 5.

In one embodiment, a set of package formation steps designed for running a Kliklok machine is utilized. The Kliklok formation steps begin when a blank, such as the blank 100 shown in FIG. 1, is placed in the hopper of a Kliklok carton formation system with the printed side out.

Figure 6:
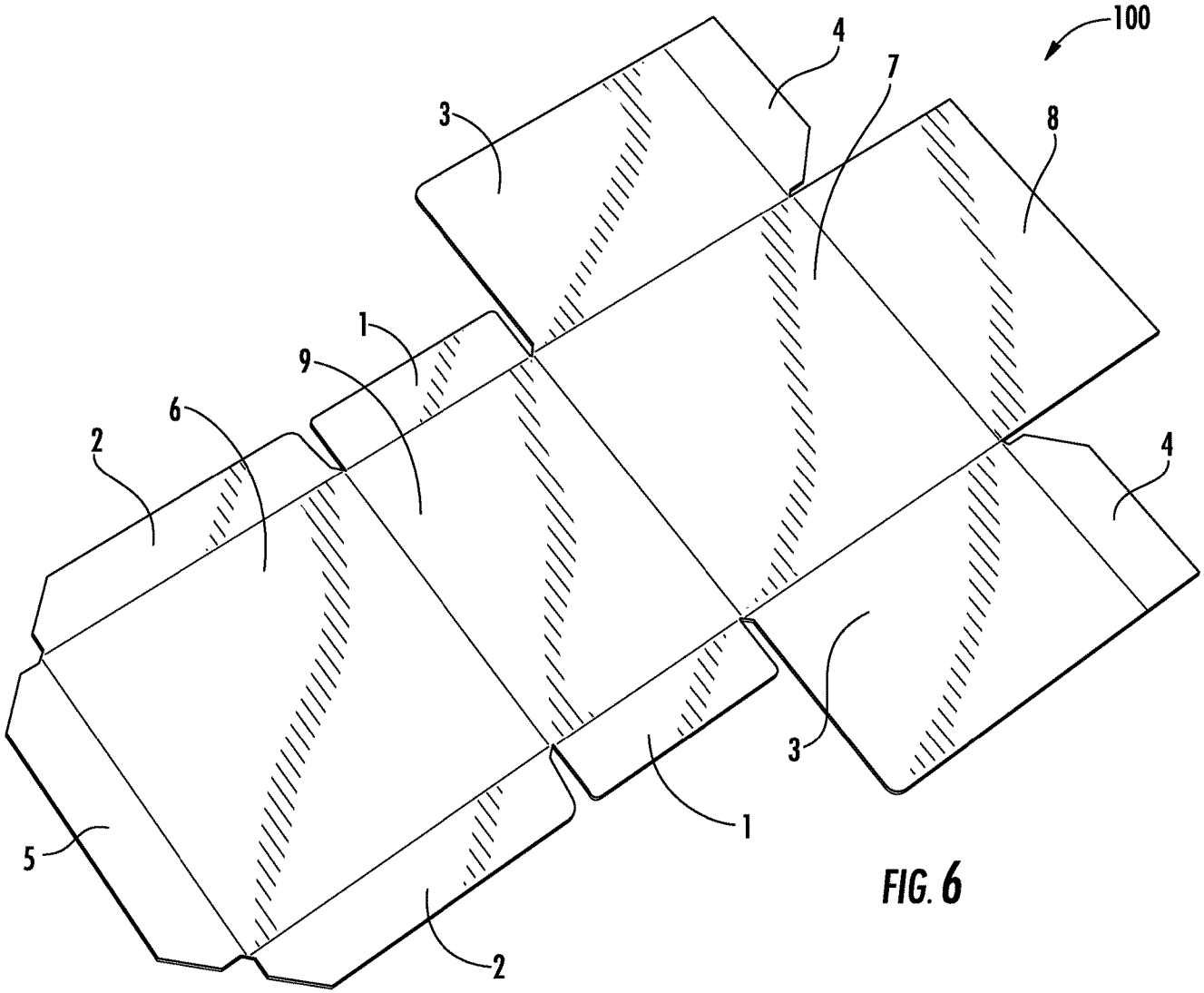
FIG. 6 depicts a blank for forming a carton in a flat condition prior to initiation of a carton assembly process.

FIG. 6 shows a blank 100 with the printed side facing down, i.e., the side that will form the outer surface of the carton. The blank 100 is vacuum fed to the top of a cavity in a register section of the system with the printed side down. The register section is where the blank 100 is positioned before a plunger or an arbor makes contact with the blank 100 and starts to form the carton. Register pins are used to ensure that bottom scores on the blank 100, i.e., markings, are in the proper position around the plunger bottom. Next, glue is applied to the glue spots on the flaps 1 of the top panel 9 and the flaps 2 of the front panel 6 on the printed side in accordance with the glue specification (see, e.g., FIG. 5).

Figure 7:
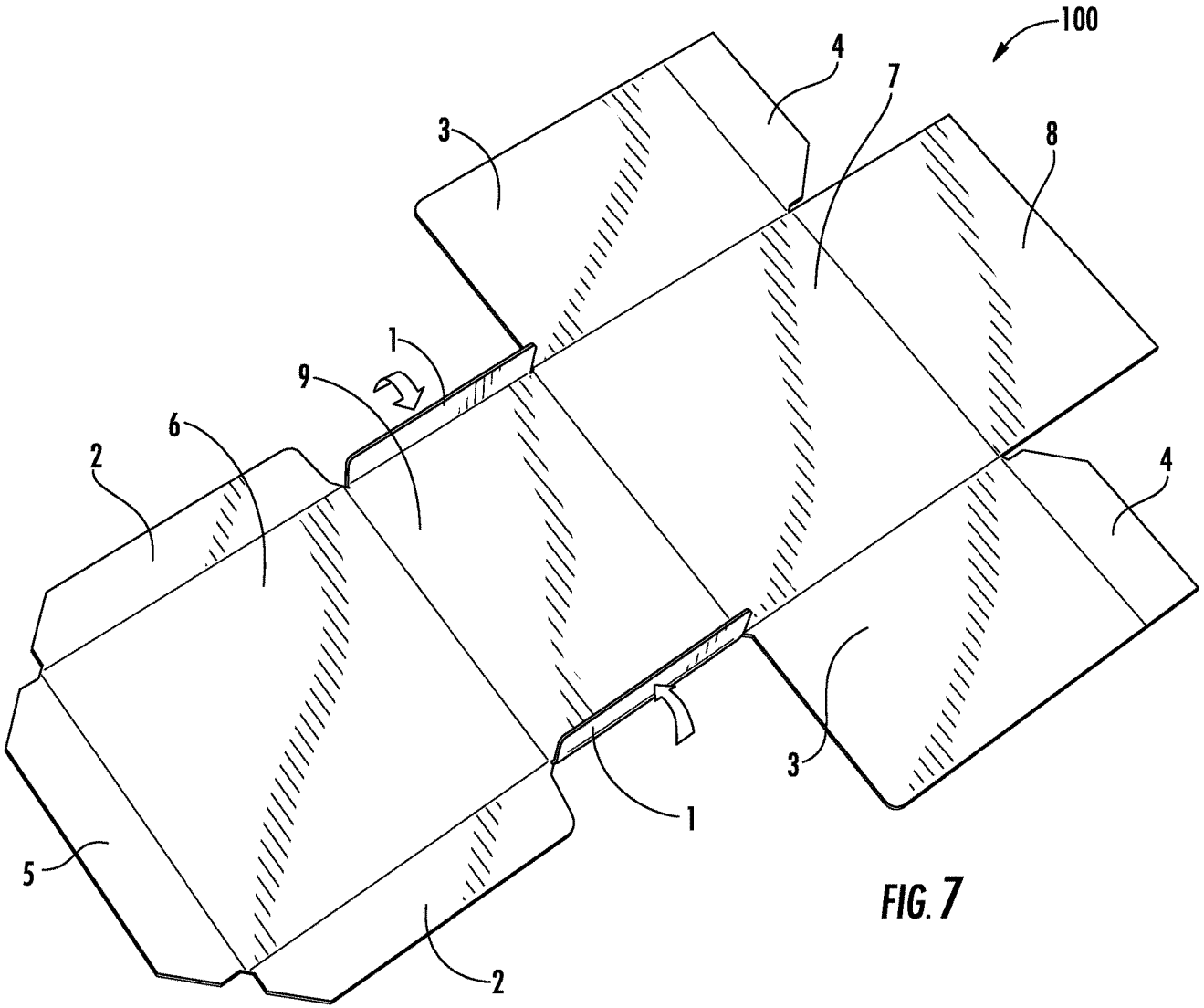
FIG. 7 depicts the blank of FIG. 6 during the carton assembly process after the flaps of the top panel have been folded.
Figure 8:
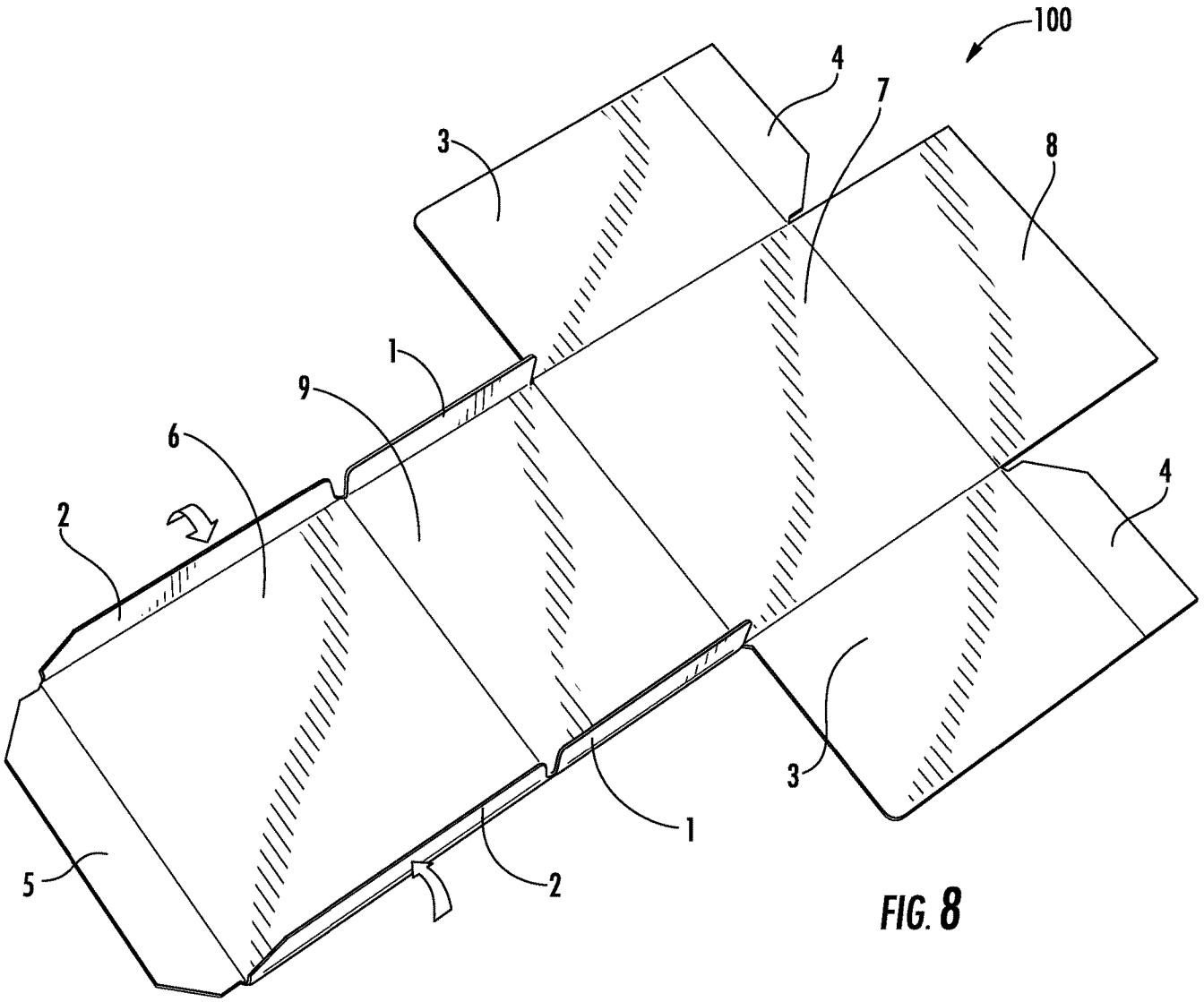
FIG. 8 depicts the blank of FIG. 6 during the carton assembly process after two opposing flaps of the front panel have been folded.

Then, the plunger of the Kliklok machine drives the blank 100 into a cavity. As the plunger drives the blank 100 in the cavity, a guide folds the flaps 1 of the top panel 9 against the plunger. Vacuum in the plunger will hold the flaps 1 as the guide leaves the flaps 1. FIG. 7 shows the blank 100 with the flaps 1 folded. The flaps 2 of the front panel 6 are folded similarly next. FIG. 8 shows the blank 100 with the flaps 1 of the top panel 9 and the flaps 2 of the front panel 6 folded.

Figure 9:
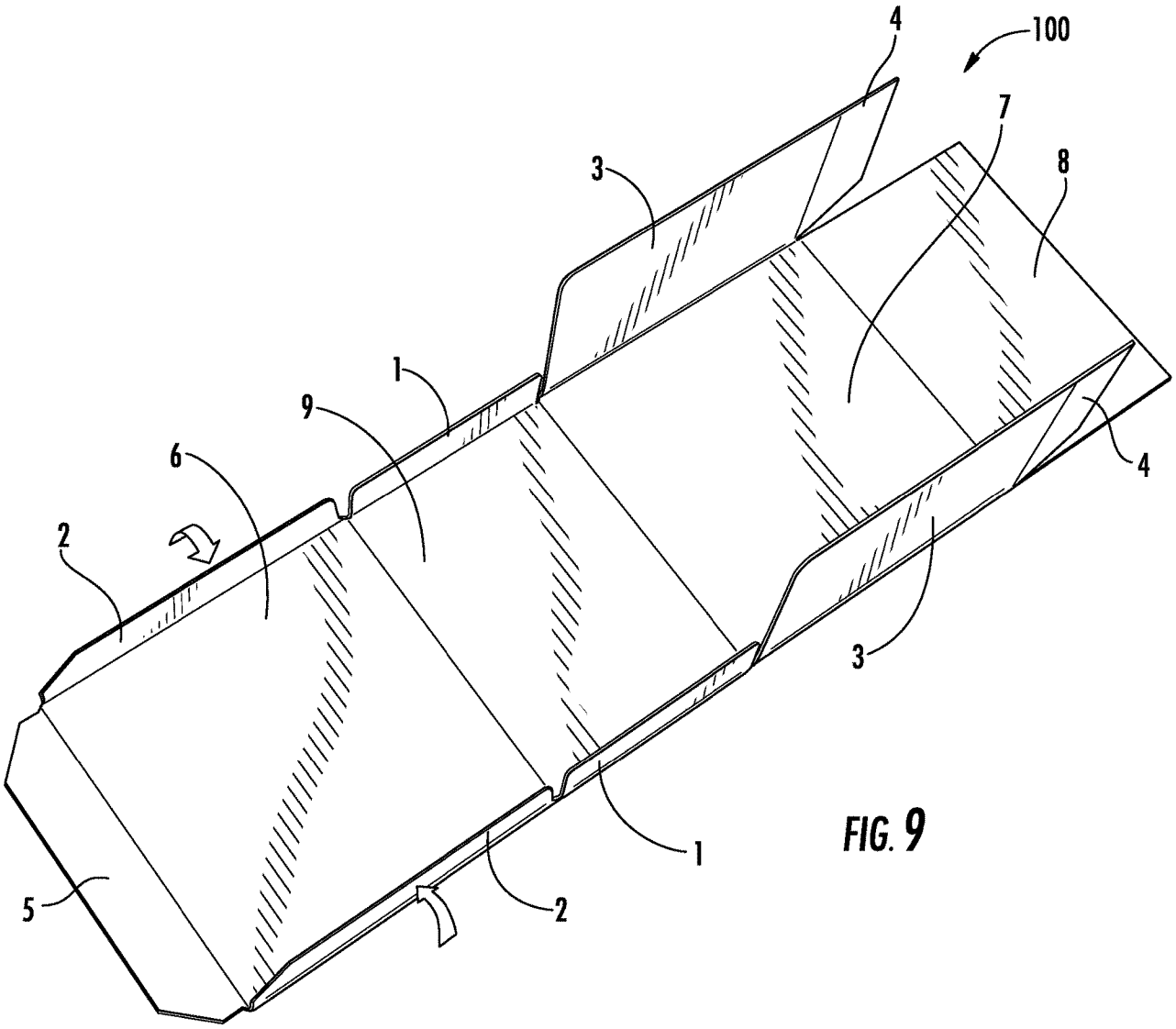
FIG. 9 depicts the blank of FIG. 6 during the carton assembly process after the side panels have been folded.
Figure 10:
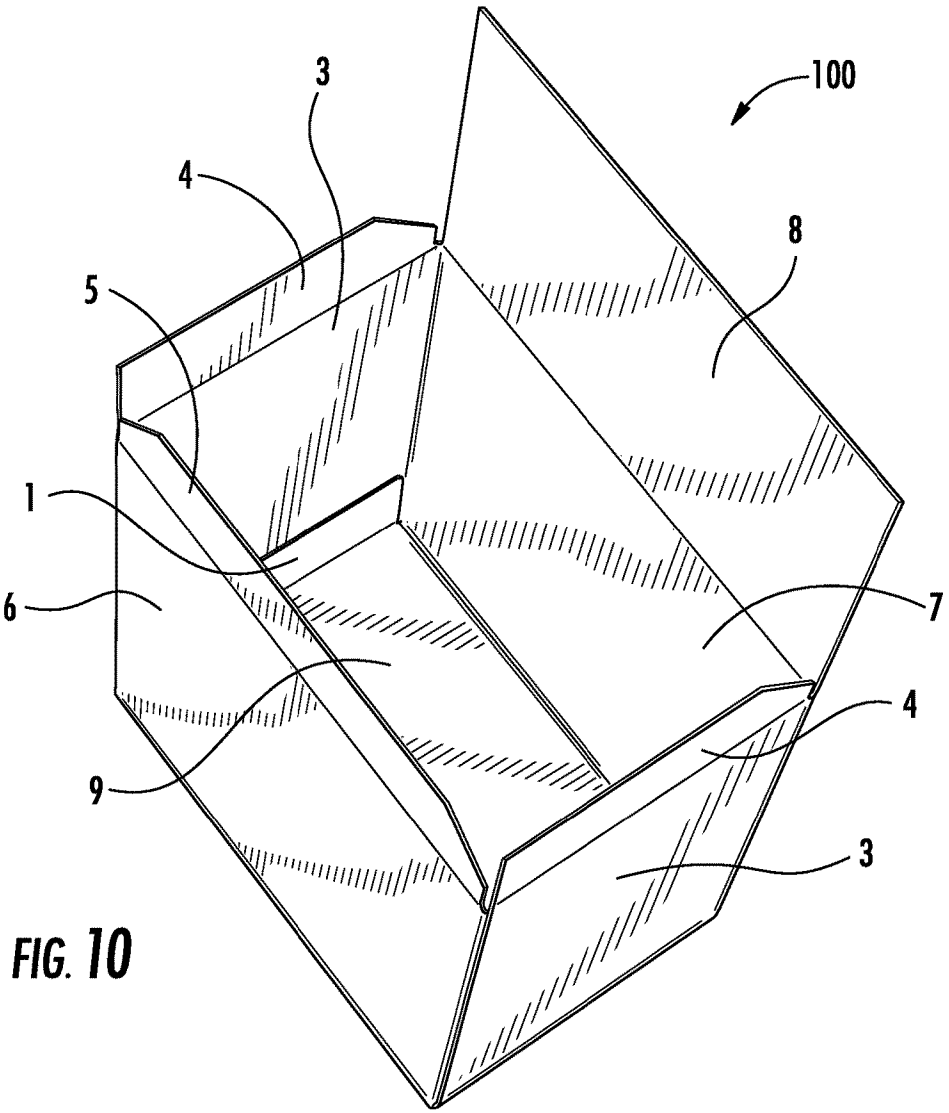
FIG. 10 depicts the blank of FIG. 6 during the carton assembly process after the blank has been plunged into a cavity, causing the front and back panels to fold.

Next, the side panels 3, to which the side panel flaps 4 are attached, are folded, as shown in FIG. 9. The front panel 6 and the back panel 7 are folded up next, as shown in FIG. 10, using folding plates while the flaps 2 and side panels 3 are wrapped around the plunger using guide rods. The mechanism ensures that the flaps 2 fold first against the flaps 1 of the top panel 9 and then the side panels 3 are folded against the flaps 2 of the front panel 6. The flaps 2 and side panels 3 will then adhere to the flaps 1 at the bottom and the side panels 3 will adhere to the flaps 2 on the two front vertical ends.

The carton will then travel through a compression section formed of, e.g., rollers, before the plunger is extracted from the carton. The carton can be stripped of the plunger either mechanically or by air, or both. The carton will next be transferred to the loading section of the system. In the loading section, the intended product (e.g., K-cups in this example) can be loaded into the partially-formed carton.

Figure 11:
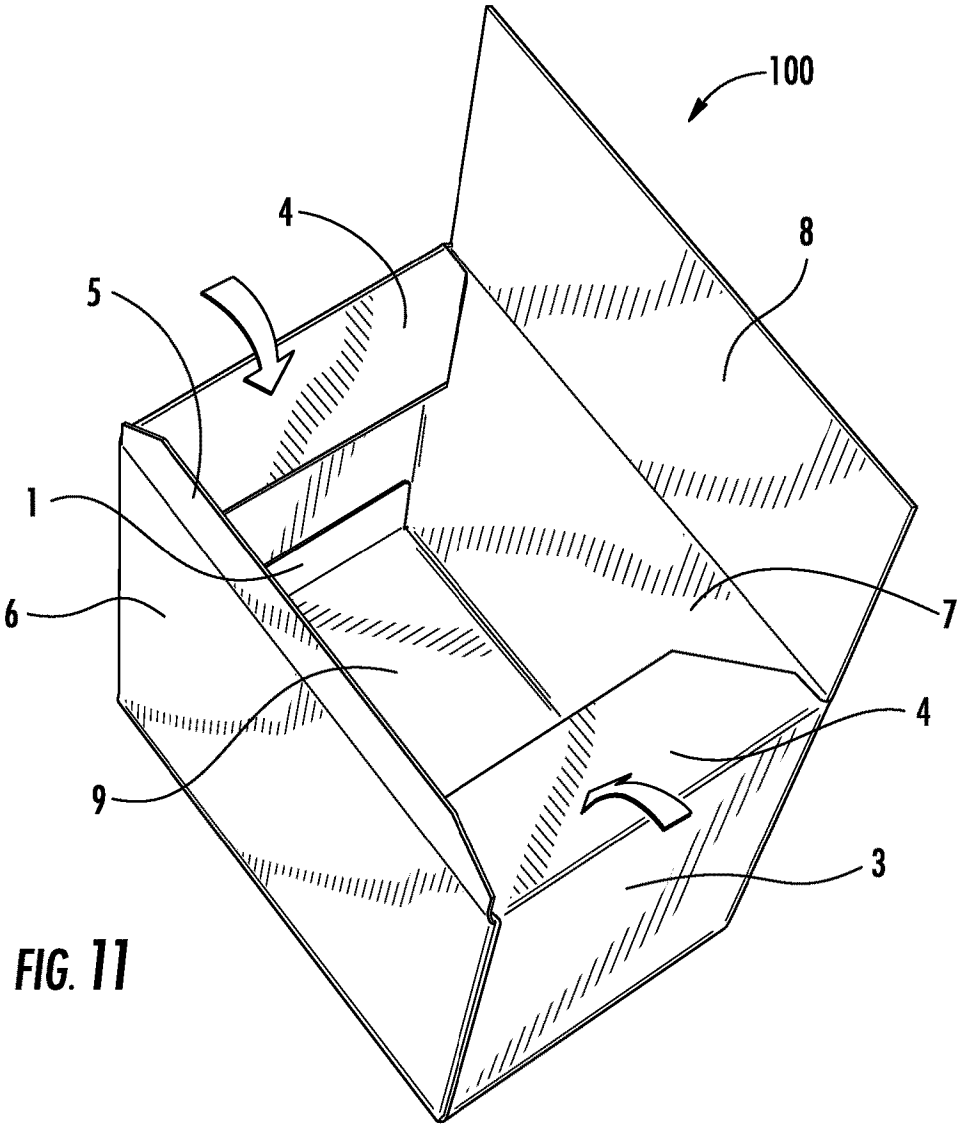
FIG. 11 depicts the blank of FIG. 6 during the carton assembly process after the side panel flaps have been talked and plowed.
Figure 12:
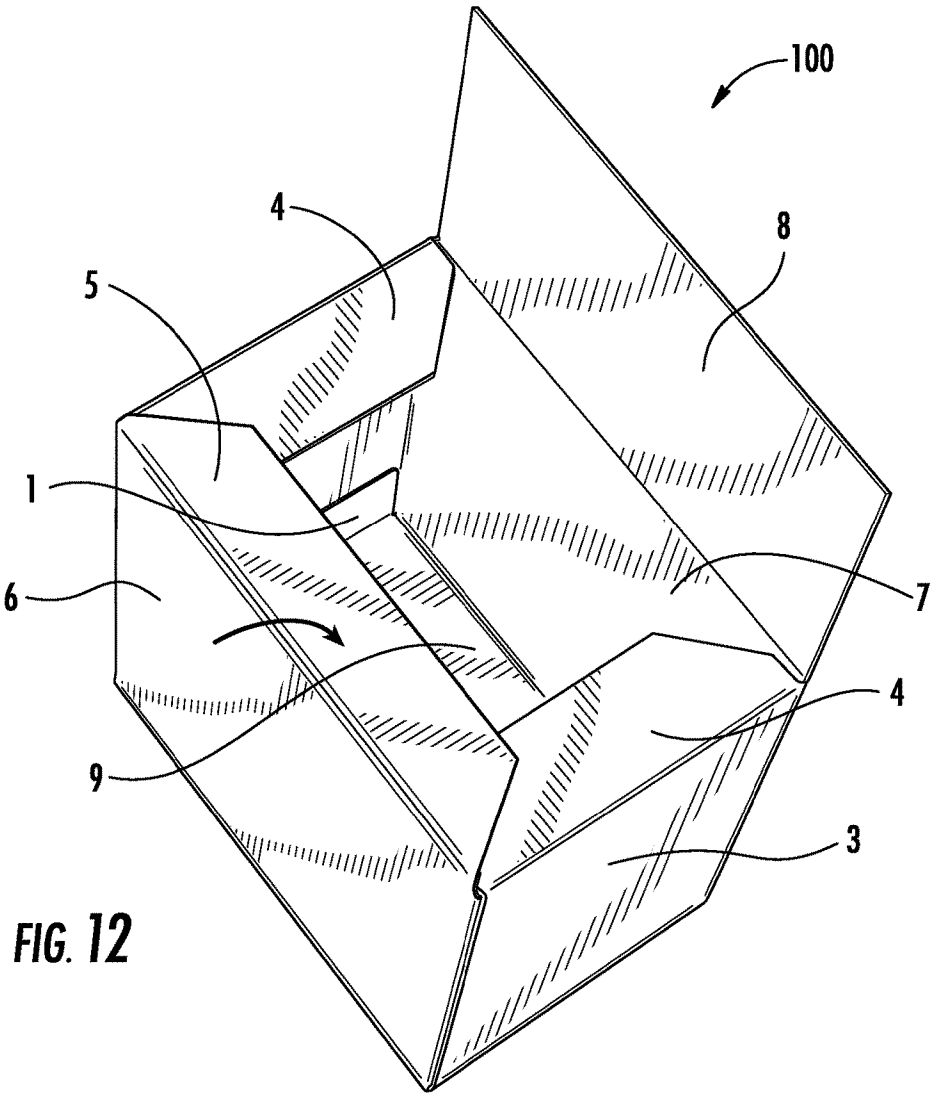
FIG. 12 depicts the blank of FIG. 6 during the carton assembly process after a third flap of the front panel has been talked and plowed.

Once the merchandise is loaded, the carton is then transferred to the next section of the system where the side panel flaps 4 are plowed and tucked, as shown in FIG. 11. Glue is also applied to the side panels flaps 4 in this section. The flap 5 of the front panel 6 which extends in the longitudinal direction of the blank 100 is plowed and glued next, as shown in FIG. 12. The machine then compresses the bottom panel 8 to the side panel flaps 4 and the flap 5 of the front panel 6.

In one embodiment, a set of package formation steps designed for running a Cama and/or Delkor machine is utilized. The Cama/Delkor formation steps begin when a blank 100 is placed in the hopper of a Cama/Delkor carton formation system with the printed side toward a cavity and the bottom panel 8 facing in the downstream direction.

Referring again to FIG. 6, the blank 100 is pulled from a magazine used for feeding blanks and placed on a conveyor with the printed side down. The blank 100 is then shuttled and glued on the inside surface of the flaps 2 of the front panel 6 and the side panels 3. As shown on the glue specification of FIG. 5, there is one glue spot on each of the flaps 2 of the front panel 6 and five glue spots on each of side panels 3. In a continuous motion, the blank 100 is shuttled into position over a cavity formed in a section of the system. When the blank 100 is placed on top of the cavity, the motion briefly stops at the section and a plunger plunges through the cavity. During the plunge, the flaps 1 on the top panel 9 are folded up against the plunger while vacuum holds the flaps 1 to the plunger.

FIG. 7 illustrates the blank 100 with the flaps 1 of the top panel 9 folded. The front panel 6 and the back panel 7 are then folded vertically while the flaps 2 of the front panel 6 and the side panels 3 are guided around the flaps 1 of the top panel 9 with guide rods. The flaps 2 of the front panel 6 are folded against the flaps 1 of the top panel 9, and then the side panels 3 are folded against the flaps 2 of the front panel 6. FIGS. 8-10 sequentially illustrate the outcome of each of these steps. The flaps 2 of the front panel 6 and the side panels 3 are next placed in position to plunge through a compression section where the flaps 1 of the top panel 9 and flaps 2 of the front panel 6 are bonded on one end of the carton and the side panels 3 are bonded on the other end of the bottom. The side panels 3 are then bonded to the flaps 2 on the two right vertical corners looking down stream.

Figure 13:
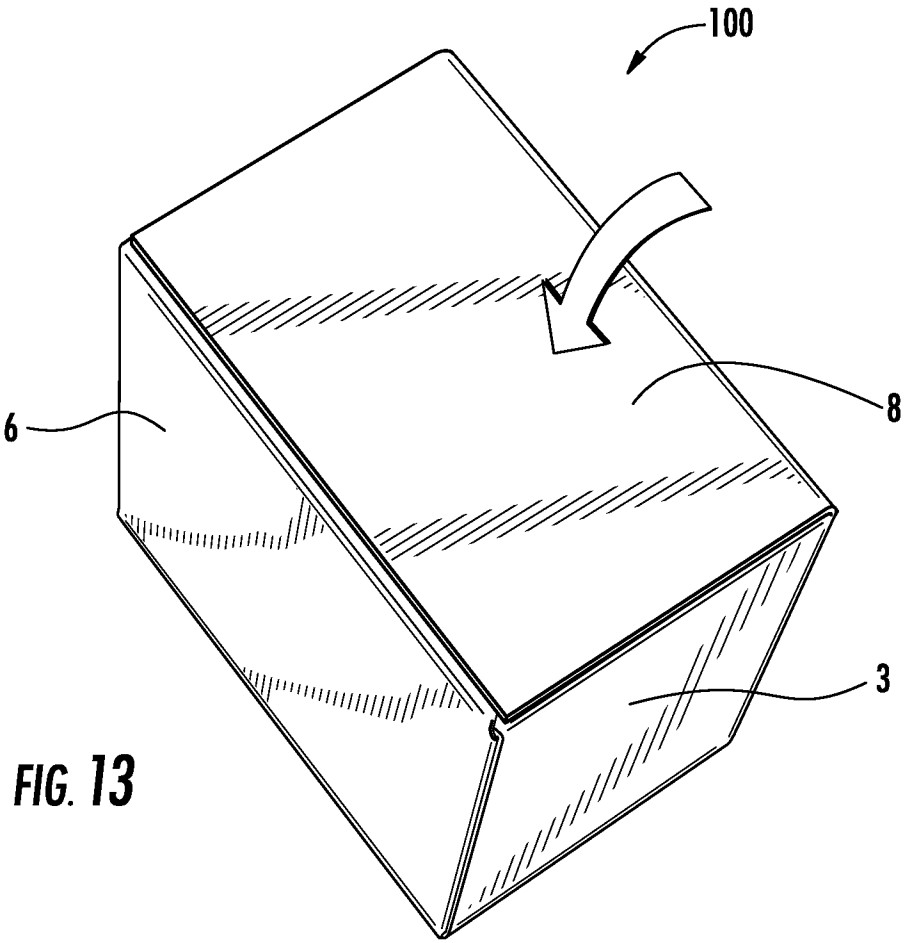
FIG. 13 depicts the blank of FIG. 6 during the carton assembly process after the bottom panel has been forwarded and glued.

The partially-completed carton is then pushed off the plunger with a pneumatic bottom foot plate. The carton is then conveyed out with the cover of the carton facing downstream and moved to a loading section. At the loading section, the carton sides are completed folded up (i.e., the side panels 3 of each carton are placed side by side) and loaded with a pick and place arm. The carton then leaves the loading section and proceeds to the next stage where side panel flaps 4 are plowed and tucked, as shown in FIG. 11. In the next stage, the flap 5 of the front panel 6 which extends in the longitudinal direction of the blank is plowed and glued, as shown in FIG. 12. The carton is then conveyed to the next section with bottom panel 8 leading, where the side panel flaps 4 are glued and the bottom panel 8 is plowed over the side panel flaps 4 and the flap 5 of the front panel 6 before the bottom panel 8 is compressed with an overhead roller to form the sealed carton, as shown in FIG. 13.

Figure 14:
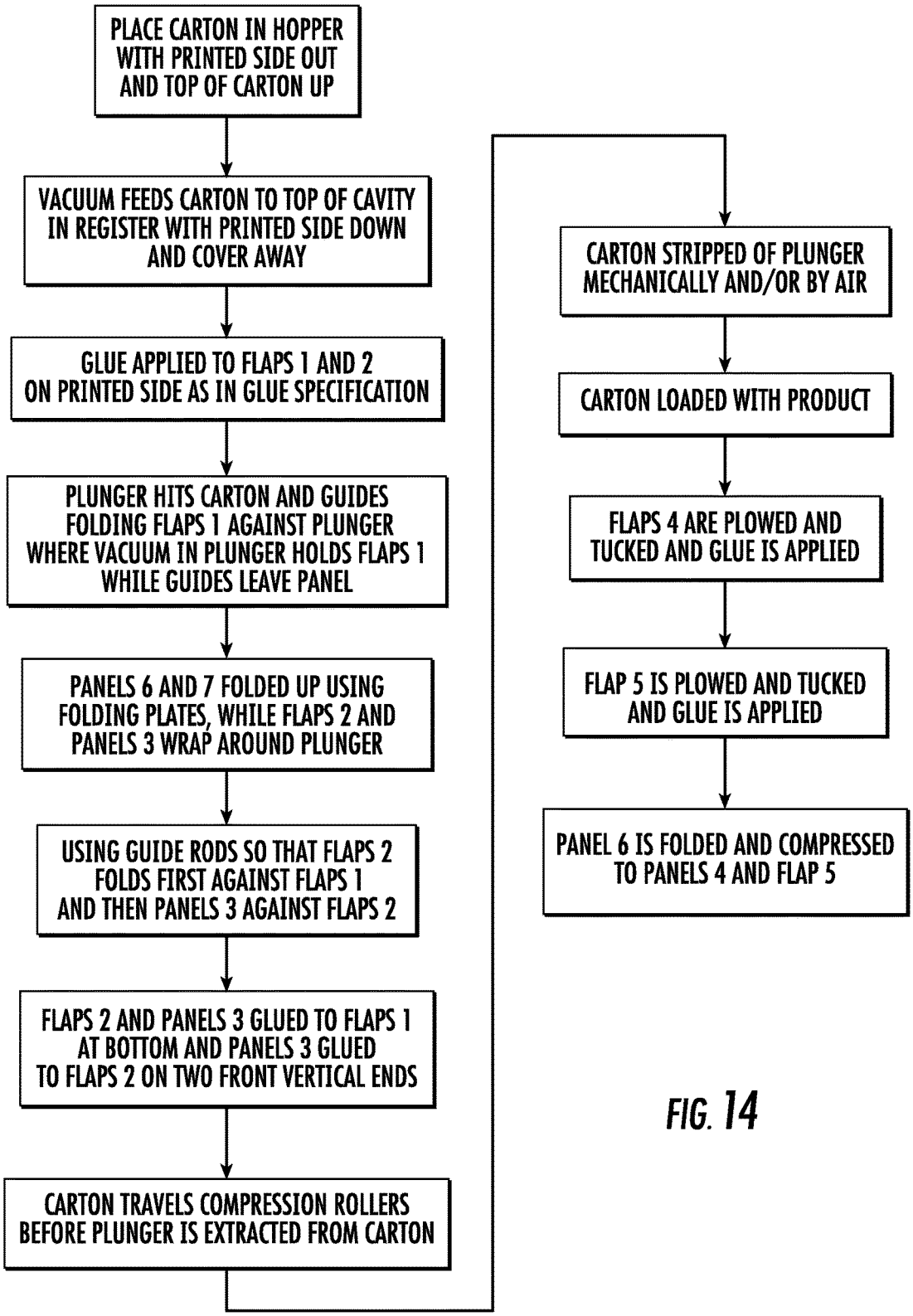
FIG. 14 depicts a process for forming a carton from the blank in accordance with the disclosed embodiments using a Kliklok carton-forming machine.
Figure 15:
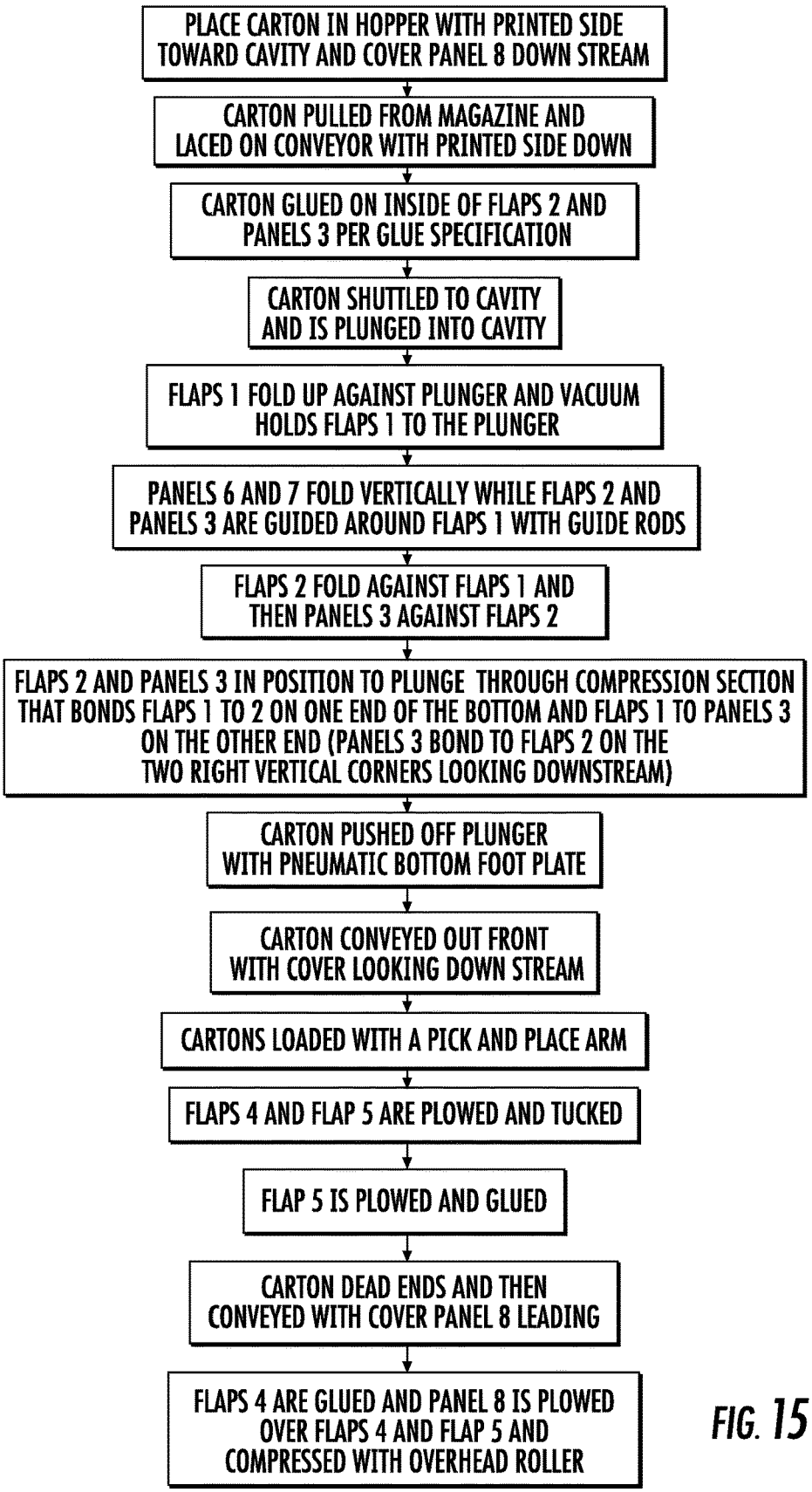
FIG. 15 depicts a process for forming a carton from the blank in accordance with the disclosed embodiments using a Delkor or Cama carton-forming machine.

FIG. 14 shows the specific steps for the formation of the carton using a Kliklok cartoning machine (or machines). FIG. 15 shows the specific steps for the formation of the carton using a Delkor or Cama cartoning machine (or machines).

Although example embodiments have been shown and described in this specification and figures, it would be appreciated by those skilled in the art that changes may be made to the illustrated and/or described example embodiments without departing from their principles and spirit.

The invention claimed is:

1. A blank for forming a carton, the blank comprising:

a first panel;

a second panel adjoining the first panel along a fold line and extending in a longitudinal direction of the blank;

only a first side panel adjoining the second panel at a first side, in a transverse direction of the blank, and only a second side panel adjoining the second panel at a second side, in the transverse direction of the blank, the first and second side panels adjoining the second panel at respective fold lines, the first and second side panels each having only a single side panel flap adjoining at a fold line, the side panel flaps extending from the respective side panels in the longitudinal direction of the blank, toward the first panel;

a third panel adjoining the second panel along a fold line and extending in the longitudinal direction of the blank, the third panel having a pair of flaps extending in the transverse direction of the blank; and a fourth panel adjoining the third panel along a fold line and extending in the longitudinal direction of the blank, the fourth panel having a pair of flaps extending in the transverse direction of the blank and a flap extending in the longitudinal direction of the blank.

2. The blank of claim 1, wherein a total width in the transverse direction of the second panel and the pair of side panels is the maximum width of the blank in the transverse direction.

3. The blank of claim 1, wherein a total length in the longitudinal direction of the first panel and the second panel is less than about half of the length of the blank in the longitudinal direction.

4. The blank of claim 1, wherein the first panel is about the same size as the third panel, excluding the pair of flaps of the third panel.

5. The blank of claim 1, wherein the second panel is about the same size as the fourth panel, excluding the flaps of the fourth panel.

6. The blank of claim 1, wherein each of the side panel flaps is chamfered at a corner nearest the first panel.

7. The blank of claim 1, wherein the blank is formed of paper, cardboard, fiberboard, paperboard, plastic, composite material, or laminated paperboard.

8. The blank of claim 1, wherein the blank is formed of a corrugated material.

9. A sheet having blanks for forming cartons, the sheet comprising:

a plurality of blanks arranged in one or more rows, the blanks of each row being adjacent to one another in a transverse direction of the blanks, with an orientation of the blanks being reversed in a longitudinal direction of the blanks in an alternating manner to form a nested arrangement of the blanks, each of the blanks comprising:

a first panel;

a second panel adjoining the first panel along a fold line and extending in a longitudinal direction of the blank;

only a first side panel adjoining the second panel at a first side, in a transverse direction of the blank, and only a second side panel adjoining the second panel at a second side, in the transverse direction of the blank, the first and second side panels adjoining the second panel at respective fold lines, the first and second side panels each having only a single side panel flap adjoining at a fold line, the side panel flaps extending from the respective side panels in the longitudinal direction of the blank, toward the first panel;

a third panel adjoining the second panel along a fold line and extending in the longitudinal direction of the blank, the third panel having a pair of flaps extending in the transverse direction of the blank; and a fourth panel adjoining the third panel along a fold line and extending in the longitudinal direction of the blank, the fourth panel having a pair of flaps extending in the transverse direction of the blank and a flap extending in the longitudinal direction of the blank.

10. The sheet of claim 9, wherein a total width in the transverse direction of the second panel and the pair of side panels of each blank is the maximum width of the blank in the transverse direction.

11. The sheet of claim 9, wherein a total length in the longitudinal direction of the first panel and the second panel of each blank is less than about half of the length of the blank in the longitudinal direction.

12. The sheet of claim 9, wherein the first panel of each blank is about the same size as the third panel, excluding the pair of flaps of the third panel.

13. The sheet of claim 9, wherein the second panel of each blank is about the same size as the fourth panel, excluding the flaps of the fourth panel.

14. The sheet of claim 9, wherein each of the side panel flaps of each blank is chamfered at a corner nearest the first panel.

15. The sheet of claim 9, wherein the blanks are arranged in a nested manner which does not have an offset in the longitudinal direction of the blanks between any blank and an adjacent blank in the same row.

16. The sheet of claim 9, wherein the height of each row is equal to the length of the blanks in the longitudinal direction.

17. The sheet of claim 9, wherein the sheet is formed of paper, cardboard, fiberboard, paperboard, plastic, composite material, or laminated paperboard.

18. The sheet of claim 9, wherein the sheet is formed of a corrugated material.

* * * * *